US006516718B2

(12) United States Patent
Kamoda et al.

(10) Patent No.: US 6,516,718 B2
(45) Date of Patent: Feb. 11, 2003

(54) INKING APPARATUS FOR PRINTING PRESS

(75) Inventors: Hiroyoshi Kamoda, Chiba (JP); Masaki Yokoyama, Chiba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 09/842,765

(22) Filed: Apr. 27, 2001

(65) Prior Publication Data

US 2002/0035936 A1 Mar. 28, 2002

(30) Foreign Application Priority Data

Apr. 28, 2000 (JP) ..... 2000-128853

(51) Int. Cl.[7] ..... B41F 31/02

(52) U.S. Cl. ..... 101/335; 101/216; 101/348

(58) Field of Search ..... 101/216, 217, 101/335, 348, 349.1, 350.1, 350.2, 363, 364, 351.3, 351.4, 352.04, 352.09

(56) References Cited

U.S. PATENT DOCUMENTS 4,554,869 A * 11/1985 Ranno, Sr. ..... 101/145
4,584,939 A * 4/1986 Giori ..... 101/152
4,771,691 A * 9/1988 Sakurai et al. ..... 101/175
5,224,420 A * 7/1993 Schneider ..... 101/138
5,243,910 A * 9/1993 Burch ..... 101/424
5,357,864 A * 10/1994 Ohta et al. ..... 101/148
5,709,147 A * 1/1998 Uera et al. ..... 101/350.1
6,050,188 A * 4/2000 Bolza-Schunemann ..... 101/183
6,101,939 A * 8/2000 Giori et al. ..... 101/177
6,311,617 B1 * 11/2001 Herden et al. ..... 101/350.3
6,382,098 B2 * 5/2002 Inoue et al. ..... 101/177

FOREIGN PATENT DOCUMENTS

JP 2552458 B2 8/1996
JP 2539529 Y2 4/1997

* cited by examiner

*Primary Examiner*—John S. Hilten
*Assistant Examiner*—Dave A. Ghatt
(74) *Attorney, Agent, or Firm*—Birch, Stewart, Kolasch & Birch, LLP

(57) ABSTRACT

An inking apparatus for a printing press comprises upper and lower fountain rollers disposed and rotatably supported in respective ink fountain apparatuses; upper and lower ductor rollers supported to be rotatable in close proximity with the fountain rollers; and an ink mixing roller which is the furthest upstream ink roller to which ink is transferred from the upper and lower ductor rollers. In the inking apparatus, an intermediated metal roller and an intermediate rubber roller are provided between the ink mixing roller and at least one of the upper ductor roller and the lower ductor roller.

9 Claims, 4 Drawing Sheets

INKING APPARATUS FOR PRINTING PRESS

The entire disclosure of Japanese Patent Application No. 2000-128853 filed on Apr. 28, 2000 including specification, claims, drawings and summary is incorporated herein by reference in its entirety.

BACKGROUND OF THE INVENTION

1. Field of the Invention

The present invention relates to an inking apparatus for a printing press, and, more particularly, to an inking apparatus for a printing press capable of performing rainbow printing.

2. Description of the Related Art

An example of such printing press is a four-color double-sided simultaneous offset printing press as shown in FIG. 3.

In a printing unit 1 of the main unit, a rubber impression cylinder 2 having a paper gripping apparatus and a rubber cylinder 3 having no paper gripping apparatus are supported substantially horizontally such that the circumferential surfaces of the cylinders 1 and 2 are in contact with each other.

Four plate cylinders 4 are disposed along the circumferential surface of the rubber impression cylinder 2; and four plate cylinders 5 are disposed along the circumferential surface of the rubber cylinder 3. Inking units 6 and 7 are movably disposed such that the inking units 6 and 7 can approach and separate from the plate cylinders 4 and 5, respectively. The inking units 6 and 7 can supply ink and water to the plate cylinders 4 and 5 in a state in which the inking units 6 and 7 are in contact with the plate cylinders 4 and 5.

Meanwhile, a delivery cylinder 9 of a delivery unit 8 is disposed below the rubber impression cylinder 2. A chain 10 is disposed on the left side of the delivery cylinder 9 in FIG. 3, such that the chain 10 does not cross a space below the position at which the circumferential surface of the rubber impression cylinder 2 is in close proximity with that of the rubber cylinder 3.

Further, transfer cylinders 12 to 15 each having a paper gripping apparatus are provided in order to transfer paper from a register 11 to the rubber impression cylinder 2; and a transfer cylinder 16 having a paper gripping apparatus is provided in order to transfer paper from the rubber impression cylinder 2 to the delivery cylinder 9. In FIG. 3, reference numeral 17 denotes a feeder unit.

Accordingly, a sheet of paper fed from the feeder unit 17 and positioned by the register 11 is conveyed along a path indicated by arrows in FIG. 3; i.e., is conveyed along the circumferential surfaces of the transfer cylinders 12 to 15, the circumferential surface of the rubber impression cylinder 2, the circumferential surface of the transfer cylinder 16, and the circumferential surface of the delivery cylinder 9, in this sequence. When the sheet of paper passes through the contact point between the rubber impression cylinder 2 and the rubber cylinder 3 from the upper side to the lower side of the contact point, the opposite faces of the sheet of paper undergo printing simultaneously.

As shown in FIG. 4, in each of the inking units 6 and 7, an upper set consisting of an ink fountain roller 21*a* and an ink ductor roller 22*a* and a lower set consisting of an ink fountain roller 21*b* and an ink ductor roller 22*b* are provided. The ink fountain rollers 21*a* and 21*b* are disposed and rotatably supported in respective ink fountain apparatuses 20*a* and 20*b*. The ink ductor rollers 22*a* and 22*b* are supported to be rotatable in close proximity with the ink fountain rollers 21*a* and 21*b* and be swingable. Ink is transferred from these upper and lower rollers to an ink mixing (distribution) roller 23 and then transferred to an ink form roller 25 via an ink roller group 24 including an ink distribution roller and an ink oscillating roller. In FIG. 4, reference numeral 26 denotes an ink roller group for another color.

When so-called rainbow printing; i.e., printing adjacent areas in different colors while shading off the colors at the boundary portion therebetween, is to be performed, inks of different colors are charged in the two ink fountain apparatuses 20*a* and 20*b*, and printing is then performed. Since mixing of colors does not occur in the ink fountain apparatuses, quality of printing products is improved, and a larger amount of ink can be stored in the ink fountains in order to improve productivity.

However, in the above-described conventional inking apparatus, within each of the inking units 6 and 7, the upper and lower ink fountain apparatuses 20*a* and 20*b* are disposed radially with respect to the ink mixing roller 23 with the same number of rollers being interposed for each ink fountain, whereby ink stored in each ink fountain is transferred to the ink mixing roller 23.

Therefore, when the ink ductor rollers 22*a* and 22*b* are exchanged in order to cope with a change in printing specification of rainbow printing or the like, an operator must move the inking units 6 and 7 or must move between the opposite sides of the inking units 6 and 7, because the ink ductor rollers 22*a* and 22*b* differ from each other in removal direction (see arrows in FIG. 4). In some cases, the ink from roller 25 also must be removed temporarily. Therefore, a very long work time is needed to complete the exchange work.

Further, since a sufficient work space is not present on the upper side of the lower ink fountain apparatus 20*b*, attachment of the ink ductor roller 22*b* involves lifting the ink ductor roller 22*b* from below, and removal of the ink ductor roller 22*b* involves supporting the ink ductor roller 22*b* from below. These operations are heavy labor for the operator, resulting in imposition of a large workload on the operator.

Furthermore, in each of the inking unit 6 and 7, the operator must perform the replacement work within a narrow work space between the ink roller group 24 and the ink roller group 26 for another color disposed above the ink roller group 24. Therefore, the operator encounters difficulty in performing the work, and a large workload is imposed on the operator. In addition to the above-described problem, the conventional inking apparatus involves various other problems.

SUMMARY OF THE INVENTION

In view of the foregoing, an object of the present invention is to provide an inking apparatus for a printing press, which can shorten operator's work time and lessen workload imposed on the operator.

In order to achieve the above-described object, the present invention provides an inking apparatus for a printing press comprising: upper and lower fountain rollers disposed and rotatably supported in respective ink fountain apparatuses; upper and lower ductor rollers supported so as to be rotatable in close proximity with the fountain rollers; and an ink mixing roller which is the farthest upstream ink roller to which ink is transferred from the upper and lower ductor rollers, wherein one of the ductor rollers is located immediately adjacent the ink mixing roller and at least one intermediate roller is provided between the ink mixing roller and the other ductor roller of the upper ductor roller and the lower ductor roller.

Since attachment and removal of the upper and lower ink ductor rollers can be performed from the side of the ink fountain apparatuses where a large work space is provided, operator's work time can be shortened, and the workload imposed on the operator can be lessened.

Preferably, the upper and lower ductor rollers are supported so as to be removable upward. In this case, the workload imposed on the operator can be decreased further.

Preferably, opposite axial end portions of each of the upper and lower ductor rollers are supported, via split holders, on arms fixed to opposite end portions of a swing support shaft; and upper halves of the split holders can be swung upward to open to thereby enable upward removal of the upper and lower ductor rollers.

Preferably, the at least one intermediate roller is provided between the lower ductor roller and the ink mixing roller.

Preferably, the at least one intermediate roller consists of first and second intermediate rollers.

DESCRIPTION OF THE PREFERRED EMBODIMENT

An inking apparatus for a printing press according to the present invention will next be described by way of an embodiment and with reference to the drawings.

Figure 1:
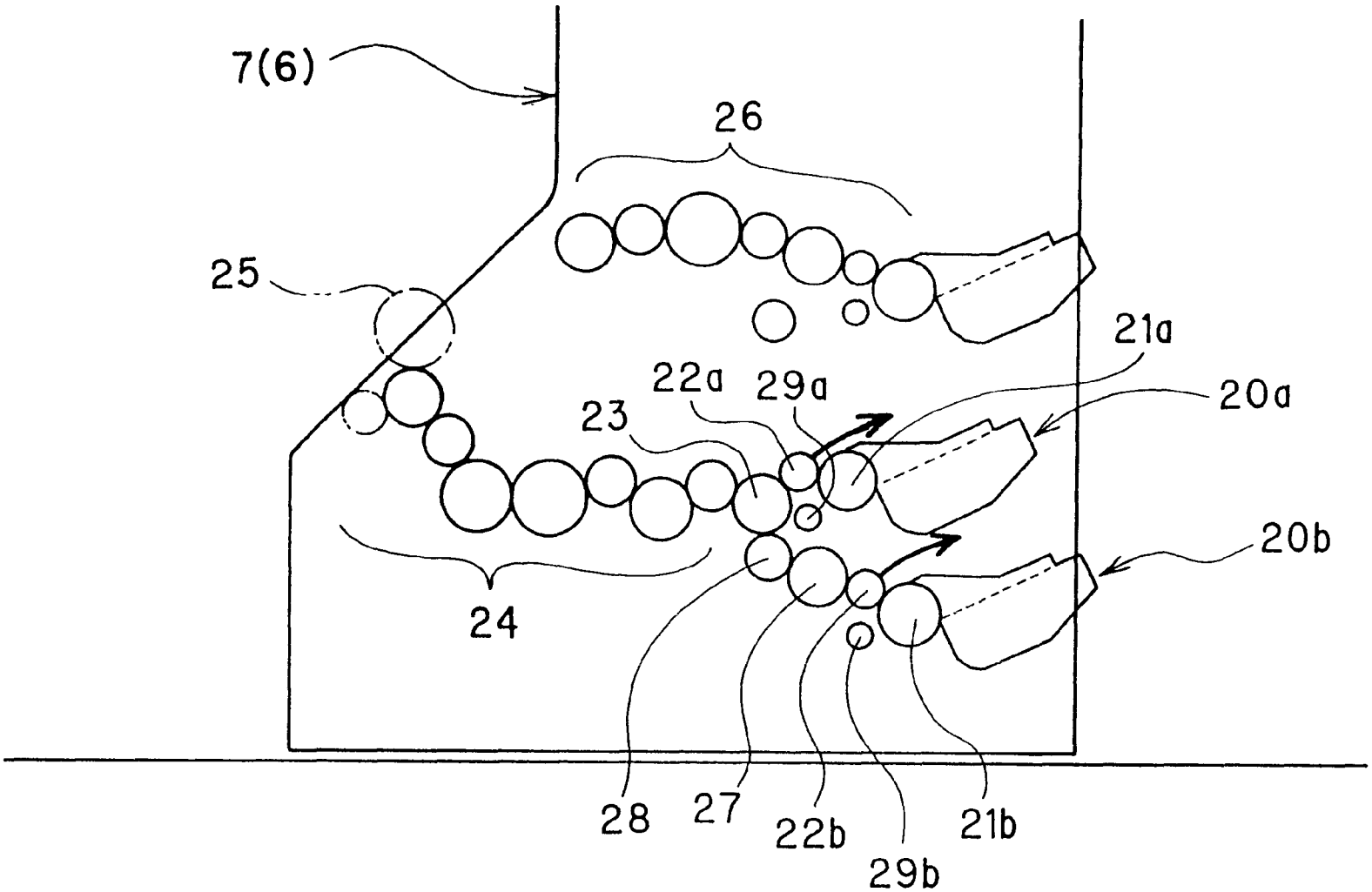
FIG. 1 is a schematic structural view showing the inside of an inking unit according to one embodiment of the present invention.

As shown in FIG. 1, in each of inking units 6 and 7, an upper set consisting of an ink fountain roller 21*a* and an ink ductor roller 22*a* and a lower set consisting of an ink fountain roller 21*b* and an ink ductor roller 22*b* are provided. The ink fountain rollers 21*a* and 21*b* are disposed and rotatably supported in respective ink fountain apparatuses 20*a* and 20*b*. The ink ductor rollers 22*a* and 22*b* are supported to be rotatable in close proximity with the ink fountain rollers 21*a* and 21*b* and be swingable about respective swing support shafts 29*a* and 29*b*.

Figure 2:
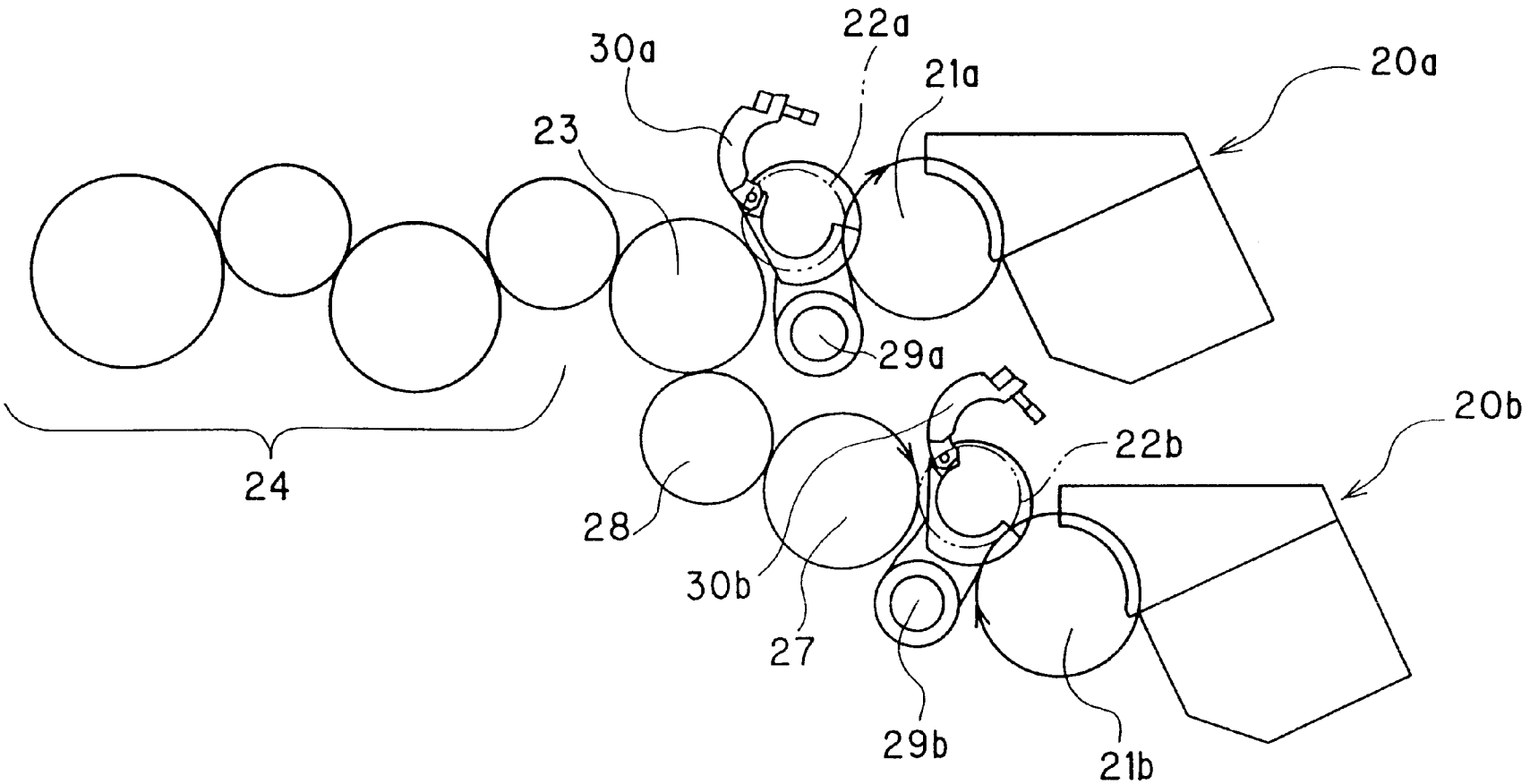
FIG. 2 is an enlarged view of a main portion of FIG. 1.

On the side of the upper ink fountain apparatus 20*a*, ink is transferred from the upper ductor roller 22*a* directly to an ink mixing (distribution) roller 23. In contrast, on the side of the lower ink fountain apparatus 20*b*, ink is transferred from the lower ductor roller 22*b* to the ink mixing (distribution) roller 23 via a first intermediate roller 27 formed of metal and a second intermediate roller 28 formed of rubber. The inks are then transferred from the ink mixing (distribution) roller 23 to an ink form roller 25 via an ink roller group 24 including an ink distribution roller and an ink oscillating roller As shown in FIG. 2, split holders 30*a* are provided on arms fixed to the opposite end portions of the swing support shaft 29*a*; and split holders 30*b* are provided on arms fixed to the opposite end portions of the swing support shaft 29*b*. The opposite axial end portions of the upper ink ductor roller 22*a* are supported by the split holders 30*a*; and the opposite axial end portions of the upper ink ductor roller 22*b* are supported by the split holders 30*b*. Upper halves of the split holders 30*a* and 30*b* can be swung upward to open to thereby enable upward removal of the upper and lower ink ductor rollers 22*a* and 22*b*.

Figure 3:
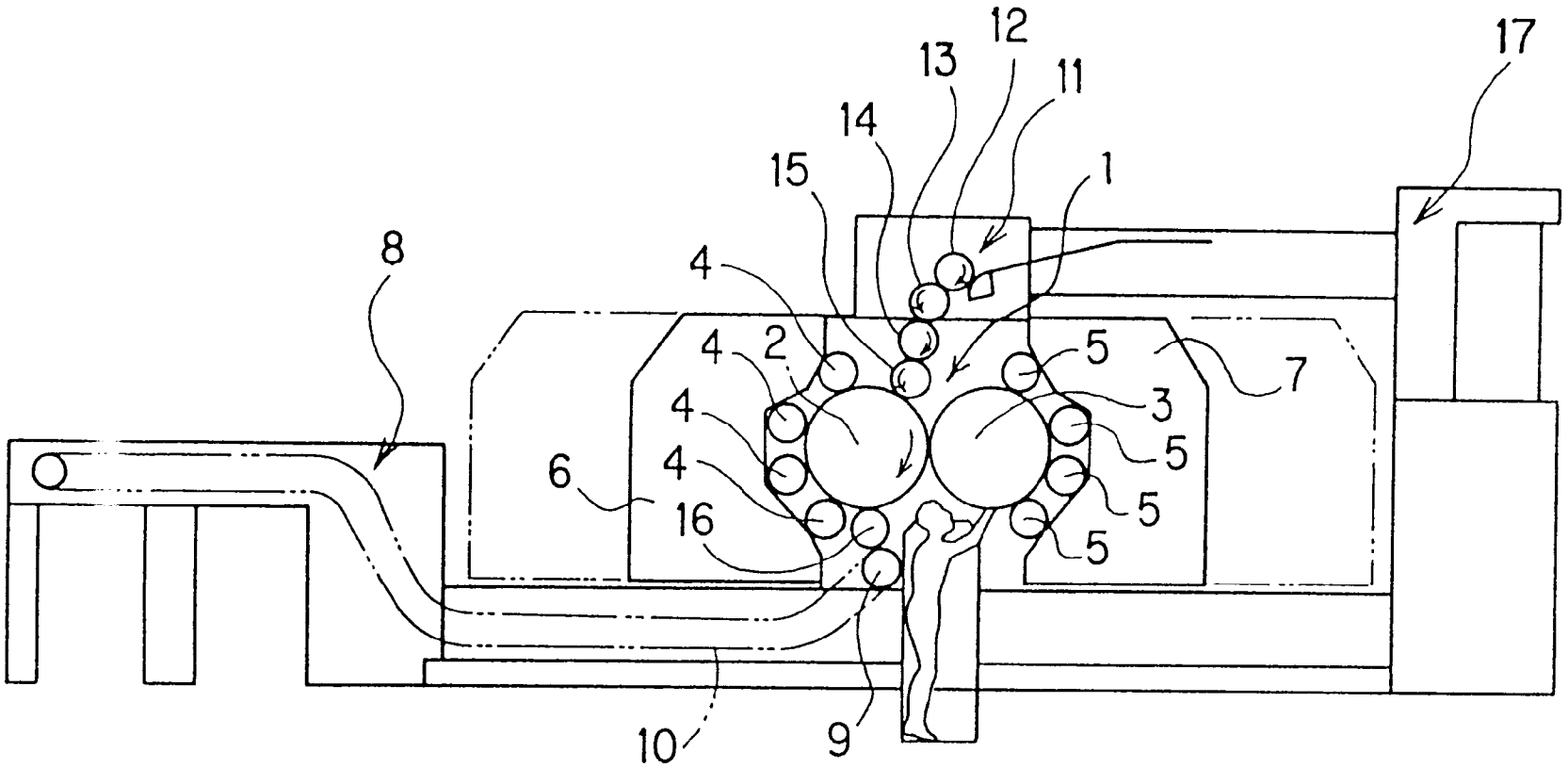
Fig.3 RELATED ART
FIG. 3 is an overall side view of a four-color double-sided simultaneous offset printing press.
Figure 4:
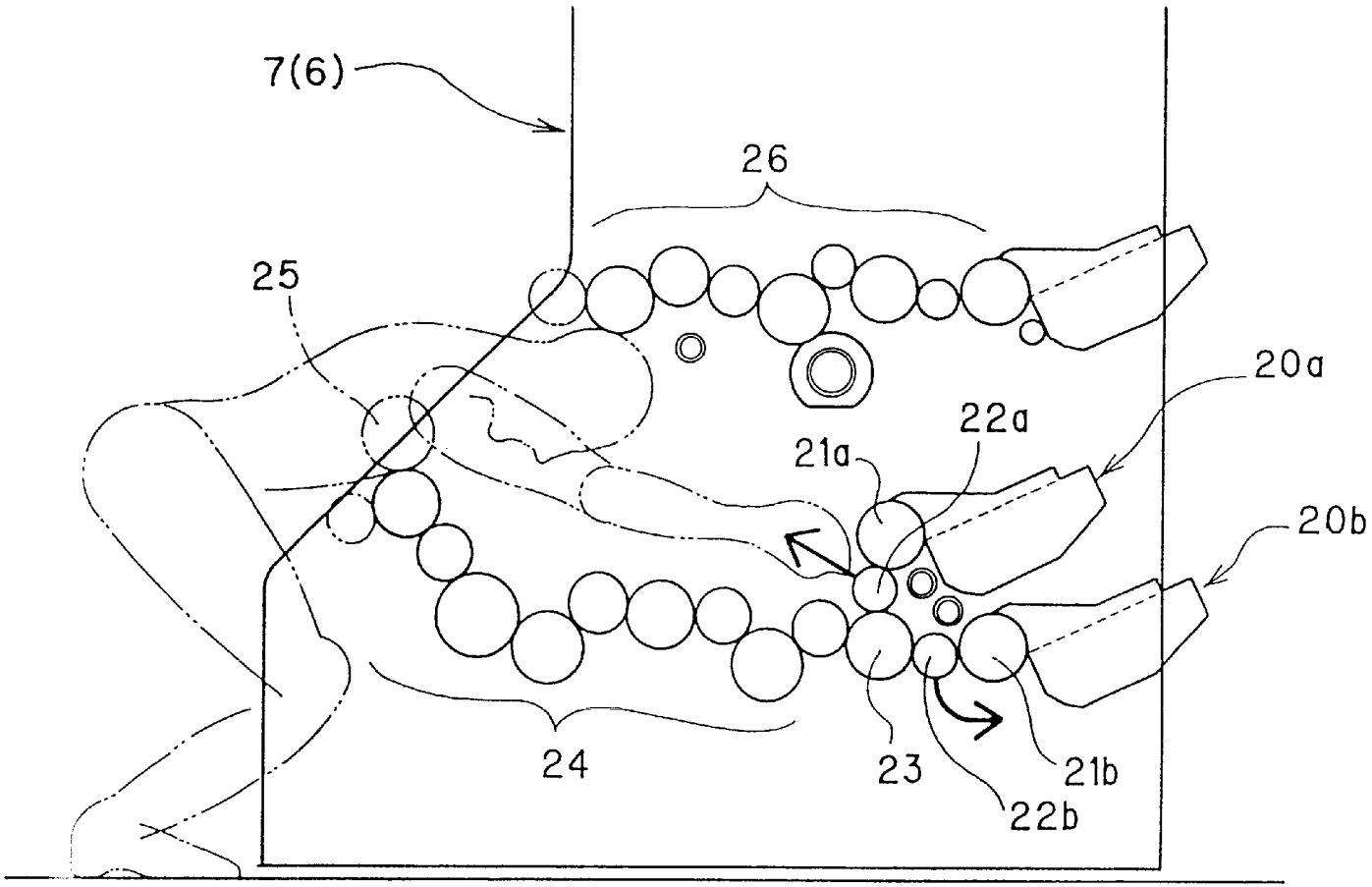
Fig.4 RELATED ART
FIG. 4 is a schematic structural view showing the inside of a conventional inking unit.

Since the structure of the remaining portion is the same as that shown in FIG. 3, detailed description thereof is not repeated here.

As described above, in the present embodiment, the intermediate rollers 27 and 28 are disposed on the side of the lower ink fountain apparatus 20*b* in order to increase the length of the row of rollers. Therefore, a work space can be secured above the lower ink fountain apparatus 20*b*.

In addition, since a work space can be secured above the lower ink fountain apparatus 20*b*, on the side of the upper ink fountain apparatus 20*a*, rollers can be disposed in such a manner that the ink fountain roller 21*a* and the ink ductor roller 22*a* are arranged along a substantially horizontal direction with respect to the ink mixing roller 23.

As a result, attachment and removal of the upper and lower ink ductor rollers 22*a* and 22*b* can be performed from the side of the ink fountain apparatuses 20*a* and 20*b* where a large work space is provided. Therefore, the work time of the operator can be shortened, and the workload imposed on the operator can be lessened.

Moreover, since the split holders 30*a* and 30*b* support the upper and lower ductor rollers 22*a* and 22*b* such that the operator can remove the upper and lower ductor rollers 22*a* and 22*b* in the upward direction, the operator can attach the ductor rollers 22*a* and 22*b* while lowering them from above. Therefore, the workload imposed on the operator can be lessened.

The present invention is not limited to the above-described embodiment, and may be modified in various manners without departing from the scope of the present invention. For example, two or more intermediate rollers may be provided on the upper ink fountain apparatus 20*a* as well as on the upper ink fountain apparatus 20*a*, or may be provided on the upper ink fountain apparatus 20*a* only.

What is claimed is:

1. An inking apparatus for a printing press comprising:

upper and lower fountain rollers disposed and rotatably supported in respective ink fountain apparatuses;

upper and lower ductor rollers supported so as to be rotatable and immediately adjacent respective upper and lower fountain rollers; and an ink mixing roller located upstream of and receiving ink from said upper and lower ductor rollers, wherein, one ductor roller of the upper and lower ductor rollers is located immediately adjacent the ink mixing roller, and at least one intermediate roller is located between said ink mixing roller and the other ductor roller of said upper and lower ductor rollers.

2. An inking apparatus for a printing press according to claim 1, wherein said upper and lower ductor rollers are supported so as to be removable upward.

3. An inking apparatus for a printing press according to claim 2, wherein opposite axial end portions of each of said upper and lower ductor rollers are supported, via split holders, on arms fixed to opposite end portions of a swing support shaft; and wherein upper halves of said split holders are adapted to be swung upward so as to open and thereby enable upward removal of said upper and lower ductor rollers.

4. An inking apparatus for a printing press according to claim 1, wherein said at least one intermediate roller is provided between said lower ductor roller and said ink mixing roller.

5. An inking apparatus for a printing press according to claim 4, wherein said at least one intermediate roller consists of first and second intermediate rollers.

6. An inking apparatus for a printing press comprising:

upper and lower fountain rollers disposed and rotatably supported in respective ink fountain apparatuses;

upper and lower ductor rollers supported so as to be respectively rotatable and immediately adjacent said upper and lower fountain rollers; and an ink mixing roller comprising a farthest upstream ink roller to which ink is transferred from said upper and lower ductor rollers, and, at least one intermediate roller located between said ink mixing roller and at least one ductor roller of said upper ductor roller and said lower ductor roller, and, wherein said upper and lower ductor rollers are supported so as to be removable upward, wherein opposite axial end portions of each of said upper and lower ductor rollers are supported, via split holders, on arms fixed to opposite end portions of a swing support shaft, and, wherein upper halves of said split holders can be swung upward to open and thereby enable upward removal of said upper and lower ductor rollers.

7. An inking apparatus for a printing press according to claim 6 wherein one ductor roller of said upper and lower ductor rollers is located immediately adjacent to the ink mixing roller and said at least one intermediate roller is located between the other ductor roller of said upper and lower ductor rollers and the ink mixing roller.

8. An inking apparatus for a printing press according to claim 7 wherein said at least one intermediate roller comprises a pair of intermediate rollers.

9. An inking apparatus for a printing press according to claim 8 wherein said one ductor roller comprises the upper ductor roller and said other ductor roller comprises the lower ductor roller.

* * * * *